US007204391B2

(12) United States Patent
Toker

(10) Patent No.: US 7,204,391 B2
(45) Date of Patent: Apr. 17, 2007

(54) ONE AT A TIME PILL DISPENSER

(76) Inventor: Jonathan David Toker, 168 Acacia Park, Newbury Park, CA (US) 91320

( * ) Notice: Subject to any disclaimer, the term of this patent is extended or adjusted under 35 U.S.C. 154(b) by 0 days.

(21) Appl. No.: 11/331,328

(22) Filed: Jan. 12, 2006

(65) Prior Publication Data

US 2006/0151521 A1 Jul. 13, 2006

Related U.S. Application Data

(60) Provisional application No. 60/643,362, filed on Jan. 12, 2005.

(51) Int. Cl.
*B65H 1/08* (2006.01)
*G07F 11/16* (2006.01)

(52) U.S. Cl. ..... 221/226; 221/208; 221/224; 221/227; 221/228; 221/229; 221/230

(58) Field of Classification Search ..... 221/226–232, 221/279
See application file for complete search history.

(56) References Cited

U.S. PATENT DOCUMENTS 3,612,349 A * 10/1971 Thomas ..... 221/4
3,688,945 A * 9/1972 Raymond et al. ..... 221/8
3,968,902 A 7/1976 Bachmann
4,171,753 A * 10/1979 Vreede ..... 221/197
4,749,106 A * 6/1988 von Schuckmann et al. . 222/96
4,854,761 A * 8/1989 Smith et al. ..... 401/196
5,071,033 A * 12/1991 Siwek ..... 221/229
5,178,298 A * 1/1993 Allina ..... 221/24
5,310,082 A 5/1994 Coustenoble
5,377,864 A 1/1995 Bleehl et al.
5,562,918 A 10/1996 Stimpson
5,791,515 A 8/1998 Khan et al.
5,812,410 A 9/1998 Lion et al.
5,975,354 A 11/1999 Goncalves
6,155,454 A 12/2000 George et al.
6,267,265 B1 7/2001 Issa
6,860,403 B1 3/2005 Mehrens et al.

* cited by examiner

*Primary Examiner*—Gene O. Crawford
*Assistant Examiner*—Michael K. Collins

(57) ABSTRACT

A one-at-a-time pill container and dispenser having a mechanism that allows for dispensing pills. Said pills are stored safely inside the device until dispensed preferably by actuating a plunger mechanism that operates by engagement to a helical cut or thread in a tube, and is maintained in place by a longitudinal cut or groove in a concentric tube. The pill is dispensed via an orifice fitted with an element-resistant septum that protects said tube contents pre-, intra-, and post-delivery. The plunger mechanism is actuated via rotation of the inner tube using a control switch. The dispenser is primarily intended for administering ergogenic substances to athletes.

22 Claims, 6 Drawing Sheets

ONE AT A TIME PILL DISPENSER

RELATED DOCUMENTS AND APPLICATIONS

Benefit of priority is claimed by the provisional patent U.S. No. 60/643,362 filed Jan. 12, 2005. This disclosure document is incorporated by reference in its entirety herein.

BACKGROUND OF THE INVENTION

The present invention relates to the general field of pill, capsule, tablet and caplet containers for dispensing by individuals. Generally speaking the capsule, pill, tablet and caplets (hereinafter for convenience collectively referred to as "pills") are medicinal and intended for ingestion by a consumer to treat a medical related condition.

There is lacking a reliable, lightweight, one-handed operation, weather-resistant method for delivery of pills for athletes during recreational or competitive endeavors. With a growing awareness of the dangers of hyponatremia (low sodium) due to salt loss and excess intake of water, athletes in many sports are becoming dependant on the use of electrolyte pills during training and competition. However, there currently exists no device in which electrolyte pills or any other pill can be stored, and dispensed on a single-dose basis while protecting the remaining pills from loss, or contamination from dirt, sweat, water or another hazard during activity.

Thus, there is a need in the art for a device that stores ergogenic substances and that is configured such that it can be used while a user is engaged in an activity. There is a further need in the art that the device for holding ergogenic substances is configured such that it can be included as a minimally obtrusive part of any equipment or article that is used by said user while engaging in said activity.

DESCRIPTION OF THE PRIOR ART

Delivery of a pill has traditionally been accomplished via mechanical devices that employ a means of isolating the pill and providing consumer access by a variety of means.

In U.S. Pat. No. 5,791,515 the rotation of a cap allows a pill to fall by gravity into the user's hand. The mechanism is a series of wedge shaped chambers, sized for the capsule to be dispensed, with a covering flange over the dispensing chamber, to ensure that only a single capsule enters the dispensing aperture. The problem with this design for capsule delivery during activity is the specific necessity for the unit to be installed in a vertical position for gravity-feed, unusable then in bicycle bars or in any non-vertical position. Furthermore, the unit only dispenses capsules of a single size, comprises significant internal mechanism, and requires significant manual dexterity to operate which precludes its usage during motion such as during athletics.

The prior art exhibits, also, a lack of a dispenser adapted for active use the construction of which would enable the simultaneous dispensing of a plurality of drug-type articles at the same time, particularly articles the size and shape of which might differ. Many existing dispensers do not operate reliably and consistently.

Prior art devices are known for containing pills and the like but these are of a type which function merely as holders for the pills and which must be opened for physical removal of the pills and require actual movement of a cover or some such part as by rotation to open or unscrew a cap for removal to gain access to the pills. U.S. Pat. Nos. 6,267,265, 6,155,454, 5,377,864, 5,310,082, 3,968,902 all illustrate this limited mechanism. Where provision may have been included for manually dispensing pills from a container certain prior devices utilized relatively rotatable parts to align a pair of openings whereupon it was necessary to shake a pill out of the container through the opening thus provided. Another device from the prior art resorted to the use of a plunger for pushing pills from a container. This design was flawed due to its complicated use of a step-by-step mechanism for pushing but one pill at a time out of the container using a complicated ratchet device, unsuitable for use during active recreation. Other designs have employed springs behind a stack of pills, requiring greater overall size as well as related mechanical issues of performance.

None of these prior concepts have described anything like a simplified economically produced dispenser wherein a number of pills might be retained and protected in a storage chamber and dispensed one pill at a time by moving one part of the dispenser relative to another part thereof. Furthermore, there is no description of such a dispenser where the interrelated movable parts formed the storage chamber for the pills and which held a supply of pills captive while one pill was discharged automatically from the dispenser.

SUMMARY OF THE INVENTION

It is one object of the current invention to provide a dispenser that stores ergogenic substances and that is configured such that it can be used while a user is engaged in an activity. It is a further object of the current invention to provide a device for holding ergogenic substances configured such that it can be included as a minimally obtrusive part of any equipment or article that is used by said user while engaging in said activity The current invention provides a pill dispensing container for personal use which can be installed on or in a bicycle frame or components, or carried in a pocket for convenience. The pill dispensing container can be made for use with any kind of pill regardless of size and whether of any of various shapes and which might be manufactured as a refillable container. The dispenser of the current invention is attached to a bike or to another object in such a manner that it is minimally obtrusive to use of the bike or other object by a user. Alternatively, the dispenser can be a stand-alone unit that easily and comfortably fits into a user's pocket or another suitable holder. Examples of items to be dispensed include, but are not limited to, prescription or over-the-counter drugs, supplements, vitamins, mints, candy, nuts, and beads.

DETAILED DESCRIPTION OF THE INVENTION

Abbreviations and Terms

Figure 1:
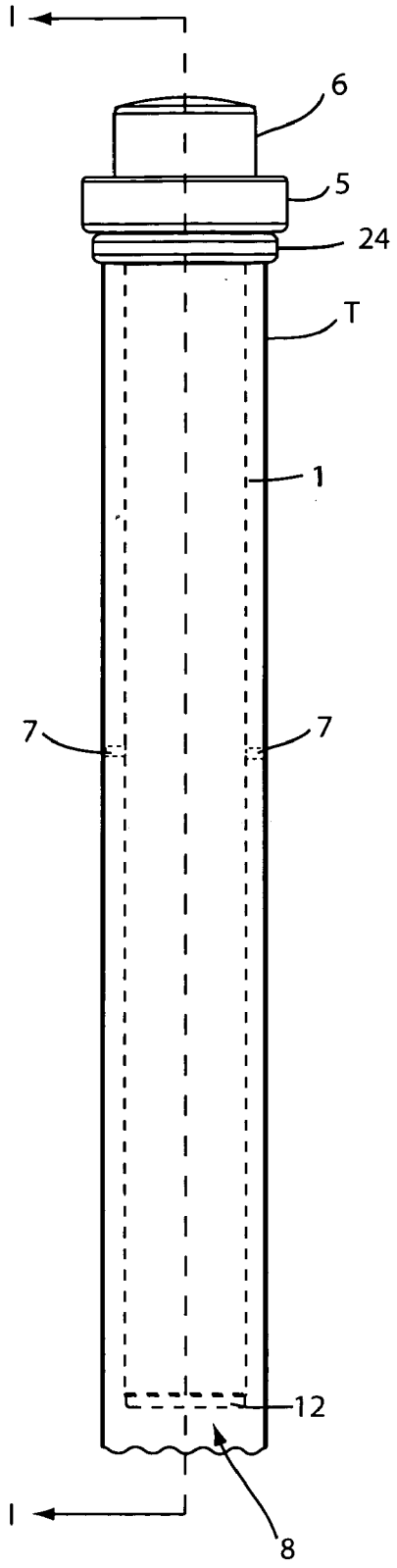
FIG. 1 is a front plan view of the present invention installed inside tube T.

In accordance with the present invention and as used herein, the following terms and abbreviations are defined with the following meanings, unless explicitly stated otherwise. These explanations are intended to be exemplary only. They are not intended to limit the terms as they are described or referred to throughout the specification. Rather, these explanations are meant to include any additional aspects and/or examples of the terms as described and claimed herein.

The following abbreviations are used herein:

The term "Bicycle bar" refers to any bicycle component employed as part of the steering and control mechanism of a bicycle. This includes road handlebars, aerobars, mountain bike bars, hand cycle bars, racing cycle bars, and related components. In the preferred embodiment, aerobars are described.

The term "Aerobar" refers to a tubular extension employed on a bicycle as part of the handlebar assembly to aid in obtaining an aerodynamic position.

The term "Control switch" refers to a member of a group comprising of knurled knob, instrument knob, pointer control knob, fluted grip knob, star knob and lobe knob.

The term "Ergogenic aid" refers to any substance, training method, food, or chemical that allows the body to perform at a higher level than if that ergogenic aid were not utilized.

The term "Helical groove" refers to any groove that is at least a single helix; however, can refer to more than a single helix, and can be of any depth, including penetration through the object.

The term "Lumen" refers to the hollow area within a tube, and may also be referred to as a void. A lumen may comprise any shape.

The term "Pill" refers to any pill, capsule, caplet, tablet, compressed powder in any shape, liquid-containing body, object containing a deliverable material or any similar embodiment in a plurality of shapes.

The term "Plunger mechanism" refers to a movable platform or rod segment that is used to drive the advance of a pill actuated by a rotation.

Figure 8:
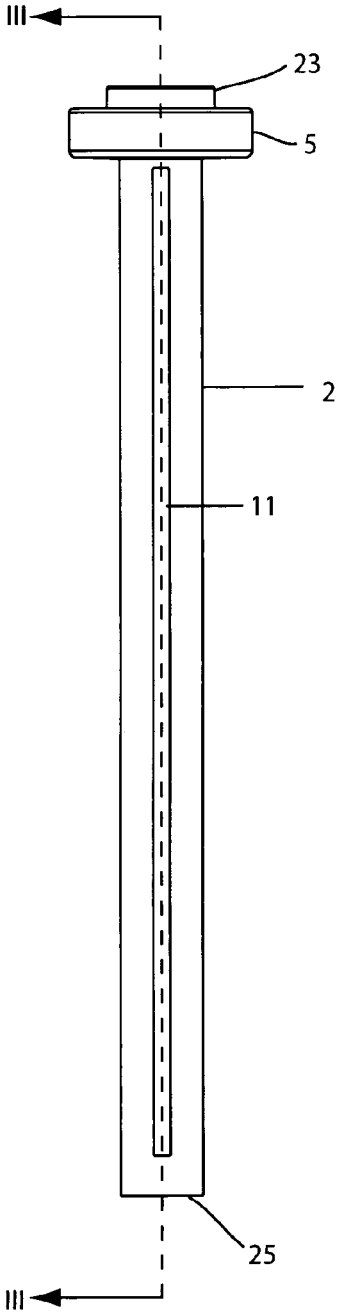
FIG. 8 is a front plan view of the inner tube, showing the cut in the tube wall and the control knob.
Figure 9:
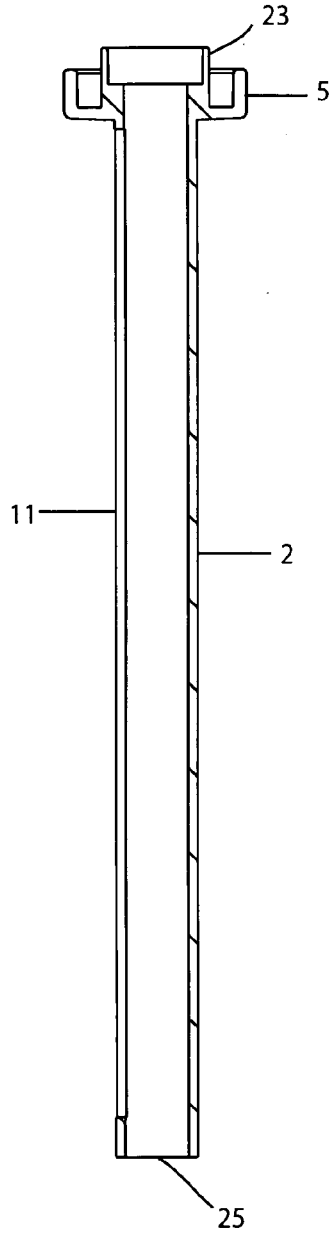
FIG. 9 is a cross-sectional view of the inner tube, taken along the lines of III—III of FIG. 8.
Figure 10:
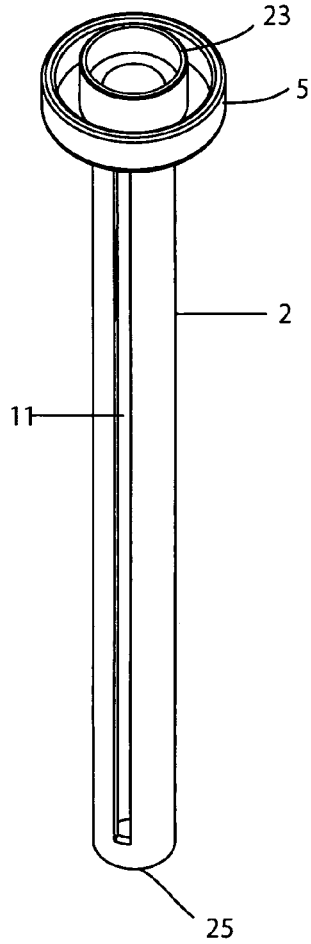
FIG. 10 is a top and front perspective of the inner tube.
Figure 11:
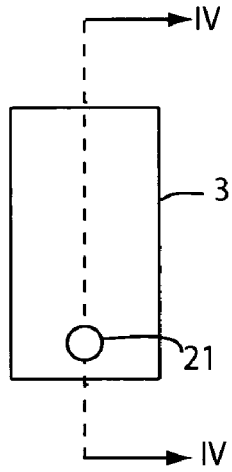
FIG. 11 is a front plan view of the plunger.
Figure 12:
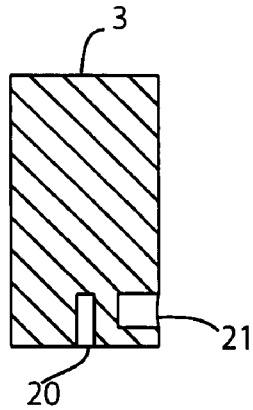
FIG. 12 is a cross-sectional view of the plunger, taken along the lines IV—IV of FIG. 11.
Figure 13:
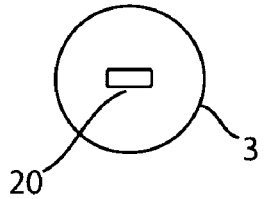
FIG. 13 is a bottom plan view of the plunger.
Figure 14:
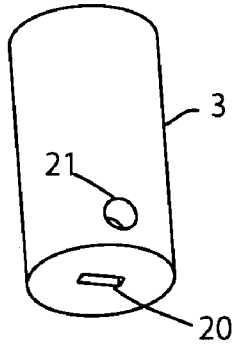
FIG. 14 is a bottom and side perspective view of the plunger.
Figure 15:
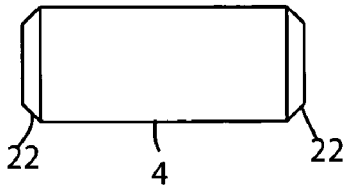
FIG. 15 is a front plan view of the engagement pin.
Figure 16:
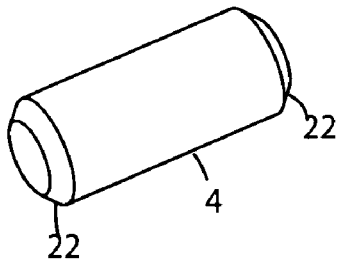
FIG. 16 is an end and front perspective view of the engagement pin.
Figure 17:
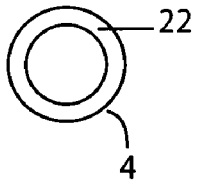
FIG. 17 is an end plan view of the engagement pin.
Figure 18:
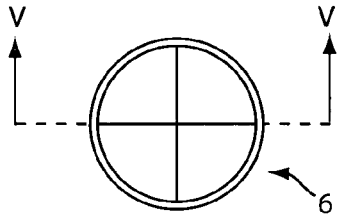
FIG. 18 is a top plan view of the orifice septum.
Figure 19:
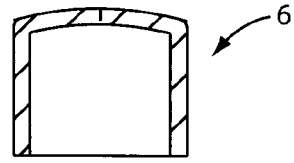
FIG. 19 is a cross-sectional view of the orifice septum, taken along the lines V—V of FIG. 18.
Figure 20:
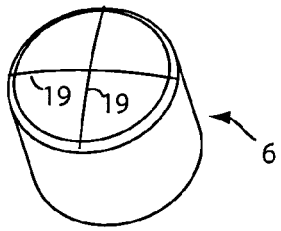
FIG. 20 is an top and front perspective view of the orifice septum.
Figure 21:
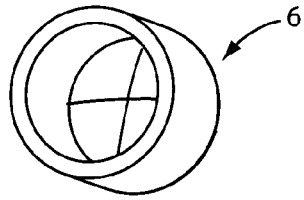
FIG. 21 is a bottom, side, and inside perspective view of the orifice septum.
Figure 22:
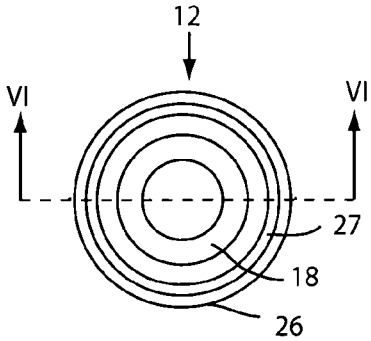
FIG. 22 is a top plan view of the end plug.
Figure 23:
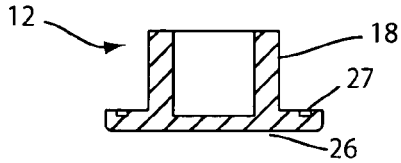
FIG. 23 is a cross-sectional view of the end plug, taken along the lines VI—VI of FIG. 22.
Figure 24:
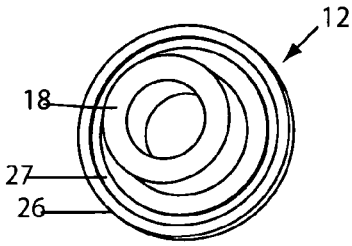
FIG. 24 is a top and front perspective view of the end plug.
Figure 25:
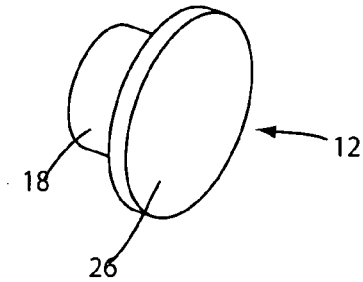
FIG. 25 is a bottom and side perspective view of the end plug.

The following list references characters used in FIGS. 1–25 to part names:

1. Outer tube
2. Inner tube
3. Plunger
4. Engagement pin
5. Control switch
6. Septum
7. Friction element
8. Dispenser assembly
10. Helical groove
11. Longitudinal cut
12. End plug
18. End cap insertion segment
19. Septum flaps
20. Plunger assembly slot
21. Engagement pin lumen
22. Engagement pin chamfer
23. Septum attachment collar
24. Outer tube collar
25. End of inner tube
26. Cap of end plug
27. Groove in end plug Descriptions:

1. Summary of the Dispenser Mechanism:

Turning to FIGS. 1, 2, 3A, and 3B, dispenser 8 is illustrated by four components: a tube, a plunger, a control mechanism, and an exit orifice. The contained pills "P" do not form a part of the present invention but are illustrated and drawn since the purpose of the invention is the storage and dispensing of pills. An external tube T in which the dispenser could be installed is also illustrated and drawn as a possible mode of installation. The following provides further detail on each component.

a. A tube with a helical cut or groove: In the preferred embodiment, this is a rigid cylindrical tube that contains a helical cut or groove 10 (FIGS. 4–7).

b. Another tube that may facilitate the dispensing of the pill. This is the preferable configuration in the 2-tube embodiment; however a single tube may be employed with a further retaining mechanism. In the preferred embodiment, Tube 2 is a rigid cylinder or tube that contains a longitudinal cut or groove 11 (FIGS. 8–10).

c. Plunger mechanism 3: A component that causes the pill to be ejected from the storage tube. In the preferred embodiment, this is a platform or solid core movable shuttle towards or away from either end of the tube in a piston-like manner (FIGS. 11–14).

d. Engagement pin 4 protruding from plunger (FIGS. 15–17).

e. Control switch 5 used to rotate the storage tube. In the preferred embodiment, the control switch forms a part of tube 2 (FIGS. 8–10).

f. Exit orifice of septum 6, which is a component that retains the pills P in storage until being dispensed (FIGS. 18–21).

g. Optional friction element 7 that is any component used to retain the dispenser within a larger unit. In the preferred embodiment, an o-ring or flat washer retains the invention within an outside tube T (FIGS. 1–7).

The preferred embodiment will now be described in this non-limiting example.

Detail of Tubes (1) and (2): FIGS. 4–10

Tube 1 (FIGS. 4–7) is cylindrical, has a lumen, is made of plastic, is between about 30 mm long and 400 mm long, preferably 145 mm long, is between 6 mm to 100 mm outside diameter, preferably 15 mm O.D., is between 4 mm to 95 mm inside diameter, preferably 12 mm I.D. and has internally threaded grooves 10. The inside diameter of tube 1 may contain a draft taper for manufacturing. The rotational pitch of the groove is between 4 mm and 25 mm linear distance per one rotation, preferably 12 mm per rotation. In this way, the dispenser will work to offer the pill to a user in a way that would not require unnecessary rotation while at the other extreme also avoiding excess projection that could lead to the loss of a pill. The width and depth of the groove is sufficient to suitably engage the engagement pin 4. In the preferred embodiment, the groove is 0.9 mm deep and 2 mm wide. Tube 1 can also exhibit an outer collar of any size and shape along tube 1 that can provide a location for holding tube 1 within an external holder or as a grasping point for removal from installation. In the preferred embodiment, 24 is a circular disk collar 4 mm wide with an outside diameter of 23 mm that is integral to tube 1.

Tube 2 (FIGS. 8–20) is cylindrical, fitted within the void of tube 1, has a slot 11 that matches the thread grooves of tube 1, longitudinally traverses the lumen of tube 1, has its own lumen, is made of plastic, and is between about 30 mm and 400 mm long, preferably 145 mm long, is between 4 mm to 95 mm outside diameter, preferably 11.5 mm O.D., is between 2 mm to 93 mm inside diameter, preferably 9 mm I.D. In the preferred embodiment, slot 11 is about 138 mm long and 2.3 mm wide, beginning about 1 mm from control switch 5 that forms one end of the tube 2.

In the preferred embodiment of the two cylinders, the first larger concentric cylinder tube 1 exhibits threaded helical groove 10 while the second smaller cylinder tube 2 contains longitudinal cut 11.

Another embodiment could have the first larger concentric cylinder exhibit a longitudinal groove, while the second smaller cylinder contains a threaded helical cut.

Yet another embodiment could have the direction of the helix in a right-hand spiral direction as observed from the orifice end of tube 1.

Yet another embodiment could have the direction of the helix in a left-hand spiral direction as observed from the orifice end of tube 1.

Yet another embodiment could have the cross section of tube 2 to be other than circular to accommodate the dispensing of shapes with a cross section other than cylindrical.

The material of choice for both tubes is plastic; however, metal, carbon fiber, or any other suitable material may be employed.

Terminal end 25 of the tube 2, opposite control switch 5, can be prepared to receive end plug 12 by means of glue, friction, screwing, expansion, or another suitable method.

Detail of Plunger (3): FIGS. 11–14

A movable platform or rod segment that is used to drive the advance of a pill. The plunger is actuated by a rotation motion and behaves as a shuttle in a piston-like motion. The plunger may be composed of a plastic rod, metal rod, or any other suitable material. The size of the plunger will be appropriate to fit within the void of, the second, smaller, cylindrical tube in such a manner as to fill the entire void. In the preferred embodiment, the plunger is a round plastic cylinder 3. Another embodiment could employ a suitably-shaped cylinder based on the cross-sectional shape of the dispensing item. The length of the plunger will be sufficient to prevent any end-over-end rotation within the tube. In the preferred embodiment, plunger 3 is approximately 16 mm long with an 8.5 mm O.D. and made of rigid plastic. The plunger may contain a lumen of suitable size and depth to contain pin 4 in a location that is consistent with the length of the plunger and dispensing action. In the preferred embodiment, the plunger contains lumen 21 that is 2.4 mm deep and 2 mm diameter, and is located 1 mm from the end of the plunger along the rounded edge surface. The plunger may contain additional lumens necessary to mechanically hold the plunger during assembly. In the preferred embodiment, a rectangular slot 20 on the flat bottom surface of the plunger is present of 1 mm by 2.5 mm wide and 3 mm deep.

Detail of Engagement Pin (4): FIGS. 15–17

In the preferred embodiment, the pin projecting from the plunger would transect the longitudinal cut and engage the groove. The pin may be composed of a rigid plastic rod, metal rod, worm screw, or other suitable material. The pin may be either integral to the plunger or as an additional piece attached to the plunger. The pin may be installed by friction, glue, screwing, or in another suitable manner.

Another embodiment could have the pin transect both cylinders and protrude through the outer cylinder.

Yet another embodiment could display multiple pins to engage in multiple helical grooves.

In the preferred embodiment, pin 4 is approximately 5 mm long with a 2 mm O.D. and made of stainless steel. The ends 22 of the pin are machined to chamfer edges. The pin is installed within the lumen of plunger 3 to a depth of 2.4 mm so that 2.6 mm is exposed, and is held in place by friction.

Details of Control Switch (5): FIGS. 8–10

A rigid protrusion on the inner tube by which a hand-operated rotation can be carried out. The knob can be composed of plastic or any other suitable material. A variety of shapes, grip surfaces, sizes are all suitable. The control switch may be either integral to the tube or as an additional piece attached to the tube. The control switch also provides attachment collar 23 for the attachment of orifice septum 6. The outer surface of the knob can be knurled or smooth, and may have embossed text. The attachment collar 23 should be of suitable size to fit orifice septum 6.

In the preferred embodiment, the knob is approximately 25 mm in diameter, 7 mm tall, and forms the end of tube 2. The outer surface of knob 5 is smooth, with dexterous grip provided by embossed text. Attachment collar 23 is 15 mm outside diameter and extends from the base of knob 5 by approximately 9 mm. The inside diameter of attachment collar 23 is 13 mm for a depth of 5 mm, then reduces to an inside diameter equal to the I.D. of tube 2, that is 9 mm in the preferred embodiment.

Details of Orifice Septum (6): FIGS. 18–21

A flexible material through which the contents of the inner tube are dispensed. The septum can be composed of plastic, vinyl, rubber, Teflon™, silicon, or any other suitable material.

The septum fulfills several needs: The septum acts as a barrier between the pills and the outer environment. The septum can also act to hold the pill once partially dispensed, so that a user can grasp and remove the pill. The septum also provides an entry point for reloading the dispenser. The thickness and shape-memory of the material allows for re-closure of the seal after reloading. As the pill is pushed outwards through the septum, the flaps begin to open, holding the pill by friction between the tips of the septum flaps, which act as fingers. The combination of septum material coefficient of friction and mechanical resilience holds the pill centered and stable. The thickness of the septum flaps provides sufficient mechanical force to partially resist against the emerging pill, and to hold the pill in place once partially exposed, and to return the flaps to their original shape and position after pill removal.

In the preferred embodiment, the septum would consist of a vinyl cylinder topped with a dome cut into four quarters 19 with each flap held at its base. The approximate size of the septum is 15 mm tall with an I.D. approximately equal to attachment collar 23 of 14 mm. The septum may be held onto attachment collar 23 by friction or another method of attachment.

In the preferred embodiment, the septum material is vinyl, with a cross-sectional thickness of approximately 2 mm. By using a thickness of vinyl, sufficient gripping force is possible as described earlier, along with sufficient mechanical resilience. This mechanical resilience also provides a water-resistant seal, as the flaps close to provide a sealed surface due to the material cohesion and shape-memory characteristics. The vinyl is also mechanical resilient in the form of weather-resistance, may be easily colored, and can be obtained in medical or food grade.

Other embodiments can include a flat septum with a stretchable opening or a domed septum with any number of flaps.

Yet another embodiment could have the septum held onto attachment collar 23 by an inner-protruding lip that could engage into a groove on the receiving surface.

Details of Friction Element (7): FIGS. 3A, 3B, 4–6

A flexible, compressible material surrounding the outer tube that will provide static friction between the dispenser and a tube in which it may be located. This piece is only necessary if the dispenser is installed in a support of larger diameter. One or more elements may be employed. This friction element may be in the form of a torus (O-ring). It may also be in the form of a flat compressible washer or set of flanges. The friction element can be composed of rubber or another suitable material. The size of the friction element will be sufficient to provide adequate friction between the outer cylinder and whatever holder the unit is placed within. In the preferred embodiment, a flat rubber washer is employed of size I.D. 11 mm and O.D. 19 mm to 25 mm, and thickness of about 1 mm. An alternate element may be an O-ring with I.D. slightly smaller than the O.D. of tube 1, or approximately 12 mm, and with a rubber thickness between 0.5 mm and 10 mm.

Details of End Plug (12): FIGS. 22–25

A solid plug that provides assembly stability to concentric tubes 1 and 2. Plug 12 is installed once tube 2 contains plunger assembly 3 and is placed within tube 1. The plug can be composed of plastic or another suitable material. Plug 12 can be installed inside tube 2 using glue, epoxy, friction, screwing or another suitable method. The size and shape of insertion section 18 of plug 12 is suitable to fit within tube 2, and end cap 26 is sufficiently large to cover the end of tube 1 so that tube 2 cannot be extracted from within tube 1. In the preferred embodiment, the insertion section 18 of end plug 12 is s smooth hollow cylinder 8.9 mm O.D., 4 mm I.D. and 5.5 mm deep. The cap 26 of end plug 12 is 14.7 mm diameter and 1.4 mm thick, with a groove 27 (11.6 mm I.D., 13 mm O.D. 0.4 mm deep). Plug 12 is installed inside tube 2 with glue.

The dispenser is designed for economical production and can be fabricated substantially from plastics for this purpose and preferably is made from only seven parts with all related parts comprising plastic elements. However other materials may be employed as well.

Those of ordinary skill in the art could employ a variety of variations of dispenser mechanisms for achieving the current invention. These mechanisms are well within the spirit of this invention.

Description of the Operation of the Preferred Embodiment a) Installation of the dispenser in the bicycle bar assembly T.

Figure 2:
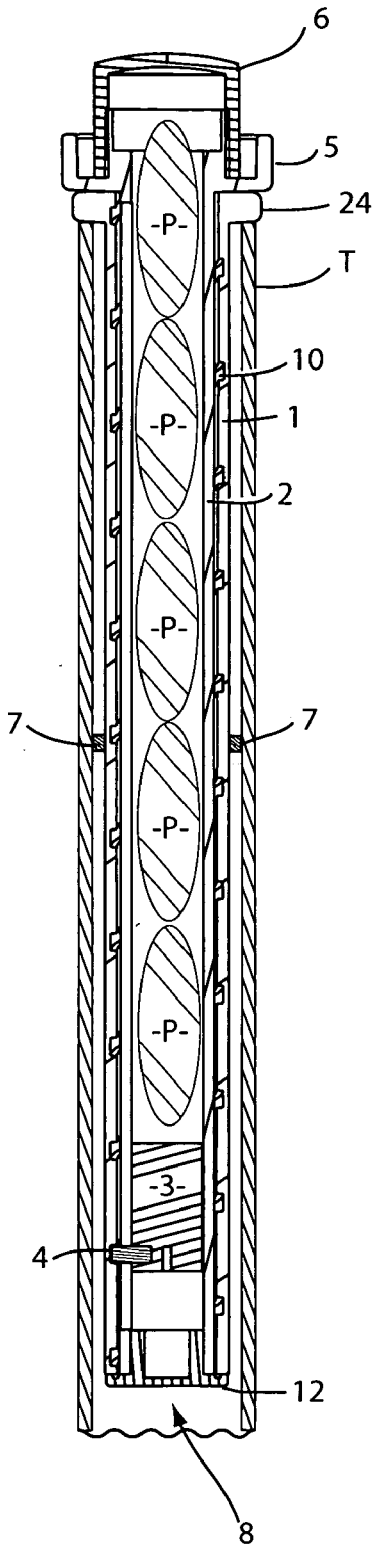
FIG. 2 is a cross-sectional view of the invention loaded with the pills P, taken along the lines I—I of FIG. 1.
Figure 3A:
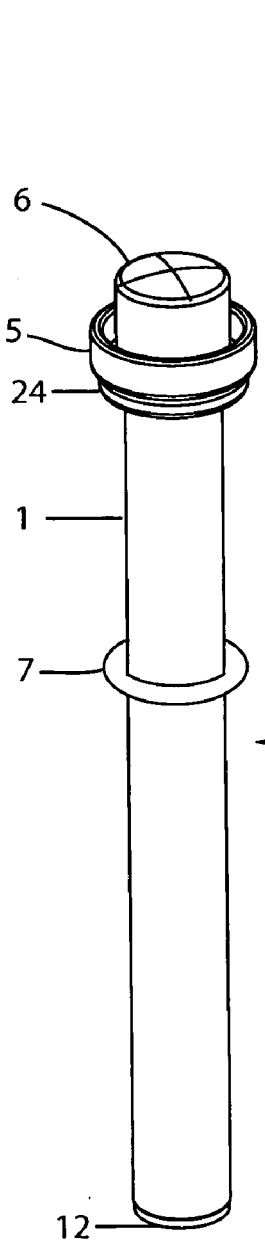
FIG. 3A is a top and front perspective, assembled view of the present invention.
Figure 3B:
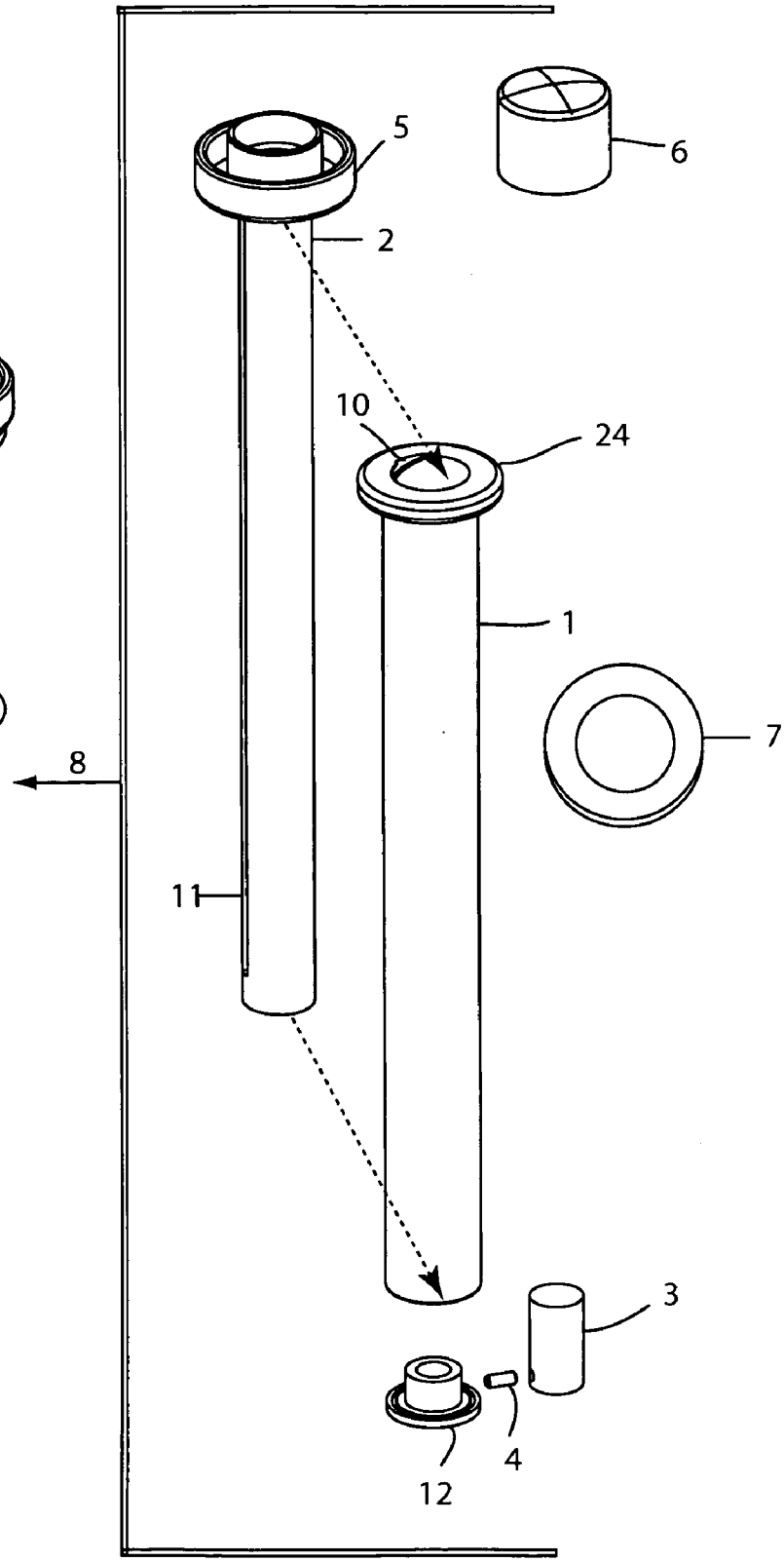
FIG. 3B is an exploded view of the present invention showing all 7 parts assembled in FIG. 3A.
Figure 4:
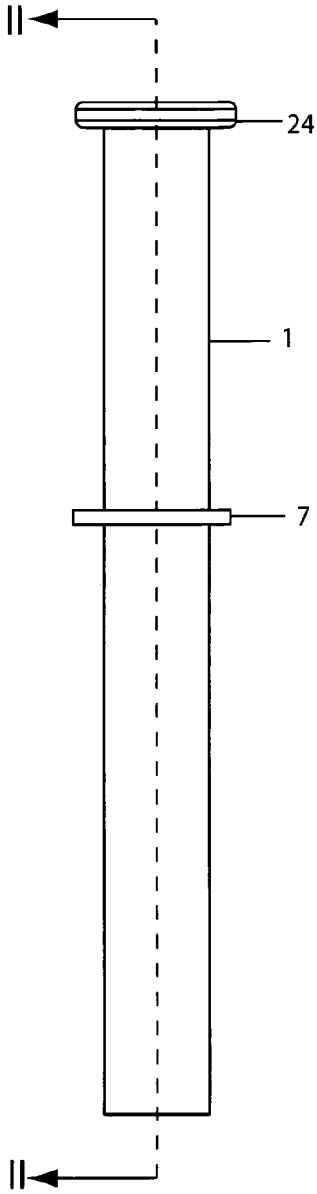
FIG. 4 is a front plan view of the outer tube.
Figure 5:
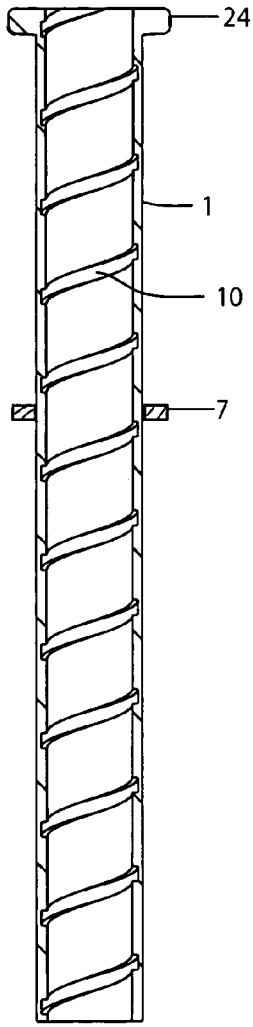
FIG. 5 is a cross-sectional view of the outer tube showing the helical groove, taken along the lines of II—II of FIG. 4;.
Figure 6:
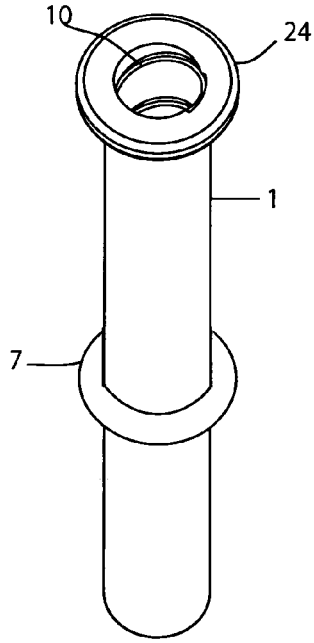
FIG. 6 is a top and front perspective of the outer tube.
Figure 7:
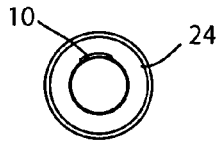
FIG. 7 is a top plan view of the outer tube with noted helical groove start.

The delivery device is inserted into the void of the bicycle bar assembly T and maintained in place via one or more friction-generating elements 7.

b) Preparation of device for loading:

The inner tube 2 is rotated using the control switch 5 so that the plunger 3 is at a point furthest from the septum 6.

c) Loading device with pills:

Easy insertion of pills is accomplished by pressing pill P against the septum 6, forcing the flaps 19 to open inwards into the void in attachment collar 23. The number of pills filled is dictated by the size of the pills as well as the desired application. The septum self-closes to seal the tube once the pill is pushed sufficiently inside the dispenser. Pills may also be loaded by removing the septum or in any manner that allows the pills to enter the storage area. A dispenser full of pills is illustrated in FIG. 2.

d) Dispensing pills:

The inner tube 2 is rotated by single-handed operation of the control switch 5. Upon rotation, the plunger 3 that is engaged via the pin 4 in the threaded helix 10 will be caused to ascend towards the orifice septum 6 driving the stack of pills P towards the septum 6. Sufficient pressure against the septum will cause the flaps to fold open outwards and expose the pill. Rotation of the tube is continued until sufficient pill is visible at which time it will be possible to grasp and remove it from the dispenser for consumption at user's leisure. The pill will be held by the septum flaps 19 until deliberately removed, completing the single-handed operation. Upon pill removal, the septum flaps will re-close automatically to their original shape to protect the remaining contents. The behavior of the septum in this manner is due to the material that provides a natural shape-memory, a resilience that provides holding of the pill during exit, flexibility to fold inwards during reloading, and sealing during all other times. Further pills can be dispensed in an identical manner until the supply is exhausted.

EXAMPLES

Example 1

The pill dispenser could be used as an accessory on a bicycle. A properly sized unit could be inserted into the void of an aerobar extension commonly used on triathlon and time trial bicycles. The orifice would be appropriately facing the cyclist for facile dispensing. The dispenser could also be installed inside the void of a handlebar commonly found on road bicycles. It would be possible to have more than one dispenser on a bicycle, easily one in each aerobar extension or bar void.

Example 2

The pill dispenser could be employed as a bicycle accessory as a unit attached to various locations on or inside the bicycle or its components. For example, on the frame, the stem, handlebars, aerobars, seat post. Further units could be attached on the bike in other locations as needed.

Example 3

Other endurance athletes, such as runners and adventure racers, could also use the pill dispenser. In this form, the dispenser could be contained in a running belt, attached to a backpack, or placed in pockets. For these applications, the dispenser may include additional features such as stability arms to prevent uncontrolled unit rotation, or to ensure proper fit into a holder. The size and shape of the dispenser could be modified to suit the individual application.

Example 4

The pill dispenser could also be employed in a racecar environment wherein the driver would desire easy one-handed access to salt tablets or other pills during a long competition. In this form, the dispenser could be attached to some location in the cockpit of the vehicle. As with other applications, the vibration and movement of the vehicle would not interfere with the dispenser operation, and the partially-dispensed pill would be held by the septum until ready to consume.

Example 5

The pill dispenser could be used for self-administered drug delivery in a home or hospital setting, with easy one-handed operation. Located in proximity to a patient, and filled with a relevant medication, the patient could dispense product as needed. The dispenser could be employed alone, or built into a hospital object, such as a bedside table or instrument cart. Multiple dispensers could be employed for various pills. Another modification could be the addition of a calendar function integrated into the dispenser to aid in dosage compliance, possibly in the form of a display indexed to the rotation of the tube. Additional features such as child safety, color-coding, and user-portability could be incorporated into the design for this application.

Example 6

The pill dispenser could be used to dispense pills to persons with a physical handicap who may only be able to actuate a dispenser with one-handed operation. Located in proximity to the usable arm, the person could dispense product as needed. This could be useful in the context of home-use, hospital use, or for athletic endeavors, such as attached to wheelchairs or racing chairs. The dispenser in this context could be carried on-person, on the frame of a personal transportation device, or inside frame components as described in example 1.

Example 7

The pill dispenser could be used to dispense pills for veterinary use at home, in a clinic, or in competition. Modifications to the size and shape of the dispenser could easily allow for veterinary-use-only capsules to be dispensed.

Additional features such as color-coding for various pills, safety features, and mounting design would be applicable to this application.

These are but a few examples listed to illustrate possible applications and usage of this dispenser whereby a variety of dispenser sizes and configurations could be constructed and employed by one of ordinary skills in the art, without departing from the spirit and scope of the invention, which is defined by the accompanying claims. Many variations on the invention will be obvious to those knowledgeable in the field, and such obvious variations are within the scope of the invention as described and claimed whether or not expressly described. For example, any combination of the aforementioned embodiments is within the scope of the present invention. It should be noted that steps recited in any method claims below do not necessarily need to be performed in the order that they are recited. Those of ordinary skill in the art will recognize variations in performing the steps from the order in which they are recited. For example, in certain embodiments, steps may be performed simultaneously. The accompanying claims should be constructed with these principles in mind.

I claim:

1. An ergogenic substance delivery device comprising: a. a housing; whence the housing further comprises a first outer tube and a second inner tube; b. an activation means; c. a dispensing means; and d. a septum, further comprising a deformable opening that functions as a pill holding or grabbing means; wherein the housing contains pills that upon activation through the activation means, the pills are dispensed through the dispensing means, and are held by, and exit through, the septum for delivery to the user.

2. The ergogenic substance delivery device of claim 1 wherein the first outer tube is a cylinder further comprising a lumen and the second inner tube is a cylinder positioned within the lumen of the first outer tube and also having a lumen.

3. The ergogenic substance delivery device of claim 1 wherein the first tube further comprises a helical groove on a surface of the first tube and the second tube comprises a longitudinal groove on a surface of the second tube.

4. The ergogenic substance delivery device of claim 3 wherein the helical groove is on the surface forming the void of the first tube and the longitudinal groove traverses the surface of the second tube.

5. The ergogenic substance delivery device of claim 1 wherein the dispensing means is a plunger, further comprising a platform and a rod.

6. The ergogenic substance delivery device of claim 5 wherein the plunger is located within the void of the second tube and the rod of the plunger is perpendicular to the longitudinal axis of the second tube.

7. The ergogenic substance delivery device of claim 1 wherein the activation means comprises rotation means and spring means.

8. The ergogenic substance delivery device of claim 7 wherein the activation means is engaged using a control switch, said control switch being selected from the group of control switches comprising of knurled knob, instrument knob, pointer control knob, fluted grip knob, star knob and lobe knob.

9. The ergogenic substance delivery means of claim 7 wherein the activation means comprises rotation means wherein the rotation of the second tube relative to the first tube translocates the plunger longitudinally through the void of the second tube to deliver an ergogenic substance.

10. The ergogenic substance delivery device of claim 9 wherein the translo cation of the plunger longitudinally through the void of the second tube further comprises the translocation of the rod through the helical groove of the first tube via the rotation of the second tube relative to the first tube.

11. The ergogenic substance delivery device of claim 1 wherein the dispensing means comprises the controlled release of a single object.

12. The ergogenic substance delivery device of claim 11 wherein the dispensing means is facilitated by the activation means, said activation means comprising rotation of the second tube relative to the first tube to translocate the plunger longitudinally through thevoid of the second tube and in turn translocates the single object longitudinally through the void of the second tube until the object is available to a user.

13. The ergogenic substance delivery device of claim 12 wherein the single object is available to a user by being delivered through the septum.

14. The ergogenic substance delivery device of claim 1 wherein the septum further comprises a dispensing, and a reloading means.

15. The ergogenic substance delivery device of claim 14 wherein the holding, dispensing, and reloading means are controlled by a mechanical resilience of the septum wherein septum shape is retained after a temporary deformation of the material.

16. A method for dispensing an ergogenic substance comprising the steps of: a. activating a control switch on an ergogenic substance delivery device of claim 1; and b. distributing the ergogenic substance through an opening in a septum; wherein said opening in said septum is useful for dispensing and holding the ergogenic substance within the septum until the user grabs the substance, thereby minimally disrupting an activity.

17. The method for dispensing the ergogenic substance of claim 16 wherein holding the ergogenic substance within the septum opening comprises partially distributing the substance through a flap opening in the septum, wherein the flaps hold the substance by friction, thereby being minimally intrusive to a user engaged in an activity.

18. The method of claim 16, wherein the apparatus comprises a first and a second tubular member wherein said second tubular member is situated longitudinally within the void of said first tubular member, and wherein the second tubular member further comprises a void that acts as a storage area for an ergogenic substance.

19. The method of claim 16 wherein distributing the ergogenic substance comprises moving the first tubular member and the second tubular member relative to each other such that an ergogenic substance is distributed to a user.

20. An ergogenic substance delivery device comprising:

(a) a first outer tube further comprising a length that is between 30 mm and 400 mm, an outer diameter that is between 6 mm and 100 mm, an inner diameter that is between 4 mm and 95 mm, thereby forming a lumen, and internally threaded grooves that have a rotational pitch between 4 mm and 25 mm;

(b) a second inner tube further comprising a length that is between 30 mm and 400 mm, an outer diameter that is between 4 mm and 95 mm, thereby allowing the second inner tube to fit within the first inner tube, an inner diameter that is between 2 mm and 93 mm and a slot that runs longitudinally along the second tube and is between 28.6 mm and 380.7 mm in length;

(c) a plunger that further comprises a platform that is between 1.9 mm and 87.8 mm diameter, thereby fitting within the inner diameter of the second tube, and an engagement pin that is between 2.5 mm and 10 mm long thereby transecting through the slot of the second inner tube and engaging in the threaded grooves of the first outer tube;

(d) a knob control switch that is between 10 mm and 166 mm diameter, and (e) a septum that further comprises a vinyl dome that is between 0.5 mm and 3.5 mm thick, four flap members formed by sectioning a portion of the vinyl dome into quarter sections, thereby providing an opening for the delivery and holding of an ergogenic substance by pushing a substance partially through the opening so that the mechanical resilience of the flaps stably holds the substance until a user manually removes it from the flaps.

21. The ergogenic substance delivery device of claim 20 comprising:

(a) a first outer tube further comprising a length of 145 mm, an outer diameter that is 15 mm, an inner diameter that is 12 mm, thereby forming a lumen, and internally threaded grooves that have a rotational pitch of 12 mm;

(b) a second inner tube further comprising a length that is 145 mm, an outer diameter that is 11.5 mm, thereby allowing the second inner tube to fit within the first inner tube, an inner diameter that is 9 mm and a slot that runs longitudinally along the second tube and is 138 mm in length;

(c) a plunger that further comprises a platform that is 8.5 mm diameter, thereby fitting within the inner diameter of the second tube, and an engagement pin that is 5 mm long thereby transecting through the slot of the second inner tube and engaging in the threaded grooves of the first outer tube;

(d) a knob control switch that is 25 mm diameter, and (e) a septum that further comprises a vinyl dome that is 2 mm thick, four flap members formed by sectioning a portion of the vinyl dome into quarter sections, thereby providing an opening for the delivery and holding of an ergogenic substance by pushing a substance partially through the opening so that the mechanical resilience of the flaps stably holds the substance until a user manually removes it from the flaps.

22. The ergogenic substance delivery device of claim 20 comprising:

(a) a first outer tube further comprising a length of 86 mm, an outer diameter that is 15 mm, an inner diameter that is 12 mm, thereby forming a lumen, and internally threaded grooves that have a rotational pitch of 12 mm;

(b) a second inner tube further comprising a length that is 86 mm, an outer diameter that is 11.5 mm, thereby allowing the second inner tube to fit within the first inner tube, an inner diameter that is 9 mm and a slot that runs longitudinally along the second tube and is 84 mm in length;

(c) a plunger that further comprises a platform that is 8.5 mm diameter, thereby fitting within the inner diameter of the second tube, and an engagement pin that is 5 mm long thereby transecting through the slot of the second inner tube and engaging in the threaded grooves of the first outer tube;

(d) a knob control switch that is 25 mm diameter, and (e) a septum that further comprises a vinyl dome that is 2 mm thick, four flap members formed by sectioning a portion of the vinyl dome into quarter sections, thereby providing an opening for the delivery and holding of an ergogenic substance by pushing a substance partially through the opening so that the mechanical resilience of the flaps stably holds the substance until a user manually removes it from the flaps.

* * * * *